US006006965A

United States Patent [19]

Hamann

[11] Patent Number: 6,006,965

[45] Date of Patent: Dec. 28, 1999

[54] SEWING NEEDLE

[76] Inventor: Andrew L. Hamann, 605 Park Cir., Clio, Mich. 48420

[21] Appl. No.: 09/160,178

[22] Filed: Sep. 25, 1998

Related U.S. Application Data

[60] Provisional application No. 60/091,912, Jul. 7, 1998.

[51] Int. Cl.[6] ..... D05B 85/00

[52] U.S. Cl. ..... 223/102

[58] Field of Search ..... 223/102, 103, 223/104; 112/222; 606/222

[56] References Cited

U.S. PATENT DOCUMENTS

| | | | |
|---|---|---|---|
| 11,769 | 10/1854 | Wilcox et al. . | |
| 592,926 | 11/1897 | Caesar | 223/102 |
| 1,055,058 | 3/1913 | Leighton | 223/102 |
| 1,235,587 | 8/1917 | Moffatt . | |
| 2,416,117 | 2/1947 | Orthwine | 223/102 |
| 2,416,260 | 2/1947 | Karle . | |
| 2,567,408 | 9/1951 | Soderberg . | |
| 3,469,548 | 9/1969 | Zocher . | |
| 4,102,478 | 7/1978 | Samoilov . | |

FOREIGN PATENT DOCUMENTS

| | | | |
|---|---|---|---|
| 828829 | 5/1938 | France . | |
| 258326 | 9/1926 | United Kingdom | 223/102 |
| 290431 | 5/1928 | United Kingdom . | |
| 344145 | 3/1931 | United Kingdom . | |
| 482116 | 3/1938 | United Kingdom | 223/102 |
| 812285 | 4/1959 | United Kingdom | 223/102 |

OTHER PUBLICATIONS (Document A) Sewing Machine Needles, Standard Gauge For 130 Different Needles, Oct. 13, 1988.

(Documet B) Foreing Document Illustratiing A Variety of Needle Structural Formats.

*Primary Examiner*—Bibhu Mohanty

*Attorney, Agent, or Firm*—Richard C. Litman

[57] ABSTRACT

A sewing needle having an eye portion with ends pinched together for retaining a plurality of threads of different sizes. The thread is placed through the eye of the needle and tugged toward the pinched end of the eye to secure the thread while sewing. This particular feature mechanically binds the thread from being removed accidently while sewing. A plurality of threads may be similarly secured for sewing requiring multi-colors or varying stitch widths or patterns.

5 Claims, 2 Drawing Sheets

SEWING NEEDLE

CROSS-REFERENCE TO RELATED APPLICATION

This application claims the benefit of U.S. Provisional Patent Application Ser. No. 60/091,912, filed Jul. 7, 1998.

BACKGROUND OF THE INVENTION

1. Field of the Invention

The present invention relates generally to a sewing needle. More specifically, the invention is a sewing needle that has an eye portion defined by pinched ends for retaining a plurality of threads of different and varying dimensions.

2. Description of Related Art

Various sewing needles have been devised having varying and different structural characteristics for a number of different applications. In performing cross stitching, which is sewing with different colored or textured threads in cloth, it is necessary to use more than one type of thread simultaneously in order to produce a design or picture having a plurality of pigments or colors. Most conventional needles lack a feature that is capable of retaining a plurality of threads simultaneously via wedging, as often desired in cross stitching or other sewing methods.

U.S. Pat. No. 11,769 issued to Wilcox discloses a needle threader for conventional needles. A grip having a double apertured shank and a protuberance on the shank. A resilient loop filament resembling a pinched eye is connected with the apertured shank extended from the shank substantially linear with respect to a central axis directed along the grip. The needle according to the instant invention is self contained and does not require the use of a needle threader as disclosed by the patent of Wilcox. Other patents disclosing similar features taught by Wilcox are U.S. Pat. Nos. issued to Karle (2,416,260), Soderberg (2,567,408) and Samoilov (4,102,478).

U.S. Pat. No. 1,235,587 issued to Moffatt discloses a needle for sewing machines. The needle consist of a body portion, a point, and an eye. Extending longitudinal of the body portion is a thread groove. Directly above the eye of the needle is a transverse scarf or groove which provides a clearance space for the looper. This allows the looper to be set so as to pass with certainty between the needle thread and the body of the needle as it enters the needle loop. The needle eye according to the instant invention is a pinched eye which retains a plurality of threads having different and varying dimensions. Moffatt fails to teach or suggest the sewing needle according to the instant invention. Zocher (U.S. Pat. No. 3,469,548) discloses a needle for sewing having similar features to that of Moffatt.

French Patent No. 828829 issued to Hiffelsheimer discloses a needle for a sewing machine consisting of a single wire shaped to form a loop midway of the wire and is embedded in a metallic block for gripping attachment to a sewing machine. The other ends of the wire are joined to form a diamond shaped loop having a blunt end. This particular design lacks the structural integrity required for high speed sewing or constant use. The wire is typically combined by metallic bonding which defines critical areas for stress fractures from repeated use. Hiffelsheimer fails to teach or fairly suggest the use of the diamond shaped loop according to the instant invention as herein described.

Other foreign patents by Cornwell (FR 290,431), Duncan (GB 344,145) and miscellaneous documents by Fabinkatias (1934) and the document entitled "Sewing Machine Needles" dated Oct. 13, 1988 disclose sewing needles of general relevance to that of the instant invention.

None of the above inventions and patents, taken either singly or in combination, is seen to describe the instant invention as claimed.

SUMMARY OF THE INVENTION

The sewing needle according to the invention has an eye with ends pinched together for retaining a plurality of threads having different sizes. The thread is placed through the eye of the needle and tugged toward the pinched end of the eye to secure the thread while sewing. This particular feature prevents the thread from being removed accidently while sewing. A plurality of threads are similarly secured in applications of sewing requiring multi-colors or varying stitch widths/patterns.

Accordingly, it is a principal object of the invention to provide a sewing needle having an improved eye which retains a plurality of threads of varying dimensions by the principle of friction.

It is another object of the invention to provide a sewing needle having improved structural integrity and rigidity as a single unit.

It is a further object of the invention to provide a sewing needle which allows for simultaneous multicolored cross-stitching.

It is an object of the invention to provide improved elements and arrangements thereof in the sewing needle according to the invention for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

The present invention is directed to a sewing needle for various sewing applications, such as multi-colored cross-stitching. A preferred embodiment of the invention is depicted in FIGS. 1–2, and is generally referenced by numeral 3.

Figure 1:
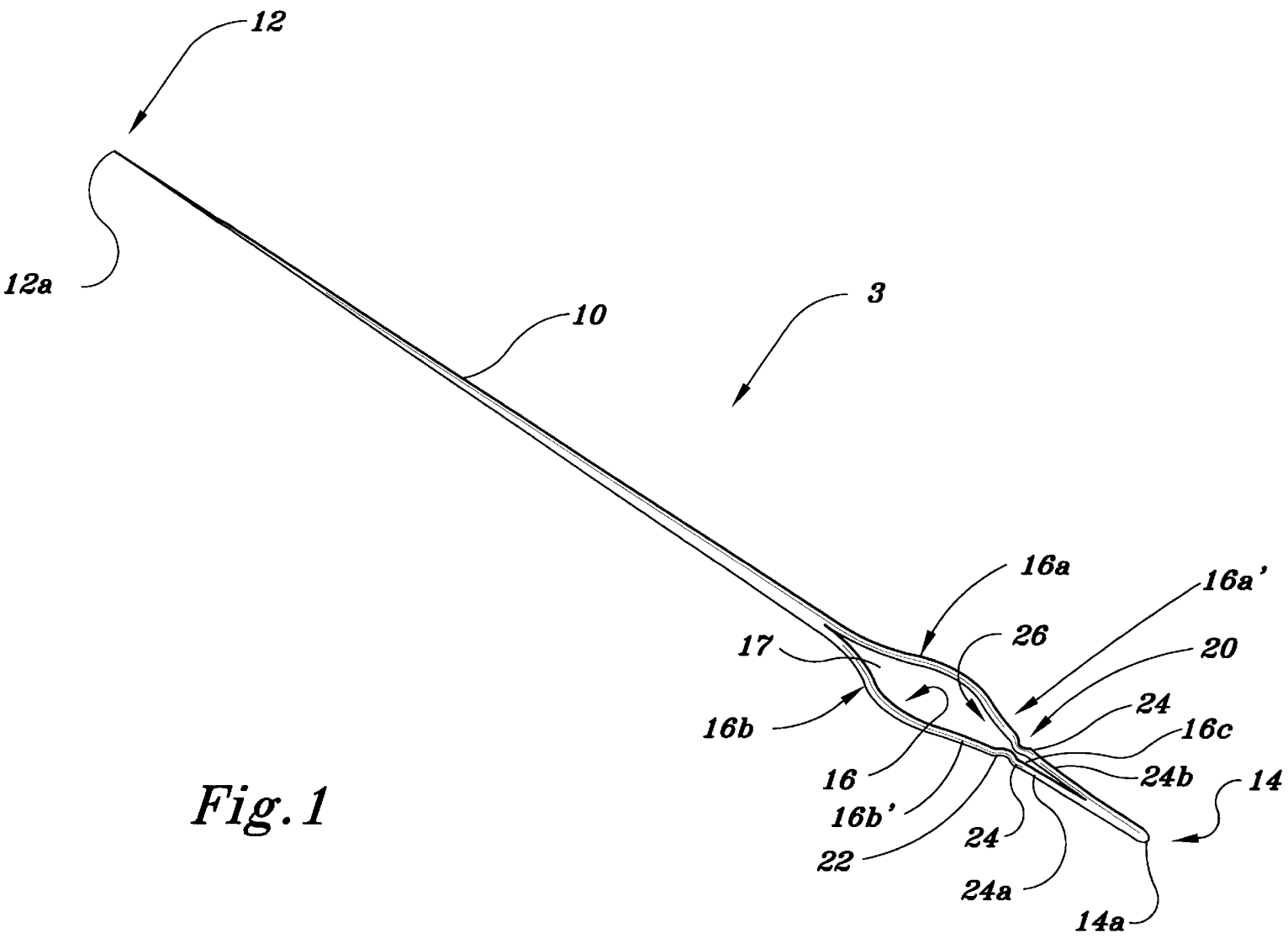
FIG. 1 is a perspective view of the sewing needle according to the present invention.

As best seen in FIG. 1, the sewing needle comprises a tapered needle shaft 10 having first and second ends 12 and 14. Each of the ends 12,14 define a needle point or sharp tip 12*a* and blunt tip 14*a*, respectively. Tip 12*a* can be blunt as well depending on the intended purpose of the needle, i.e. the type of fabric for which it is to be used. For loose-weave fabrics where clearances are relatively large between threads, blunt tips are particularly useful.

The shaft 10 further comprises an eye or otherwise hollow expanse 16 located nearest the second end 14. The needle 3 is constructed as a single unit, unlike the prior art, without folding or looping a single wire including the use of bonding methods such as metallic bonding or similar methods. In this regard, the primary eye 16 is defined by a pair of divergent branches 16*a*, 16*b* extending from the needle shaft 10, which terminates into a pair of convergent branches 16*a*', 16*b*' and 16*b*, and. The pair of covergent branches 16*a*' and 16*b*' define a pinched portion 20 formed by an inward bend 22 in each branch, thereby defining a narrowed slot 26 through which a thread is tugged. A secondary eye portion 16*c* is defined by a pair of outward bends 24 extending from pin portion 20, which terminates into a pair of convergent branches 24*a*, 24*b*, thereby forming the second end 14 of the unitary needle structure. The secondary eye 16*c* retains at least one of a plurality of threads 18, 18*a*, 18*b*, 18*c*, 18*d*, etc. by mechanical forces after being tugged through the slot 26. A suggested size opening for the secondary eye portion 16*c*, which is substantially reduced relative to the main eye portion 17, is one quarter its length and no more than two thirds its width. As shown in FIG. 1, the main eye portion 17 is greatly enlarged for illustrative clarity.

Figure 2:
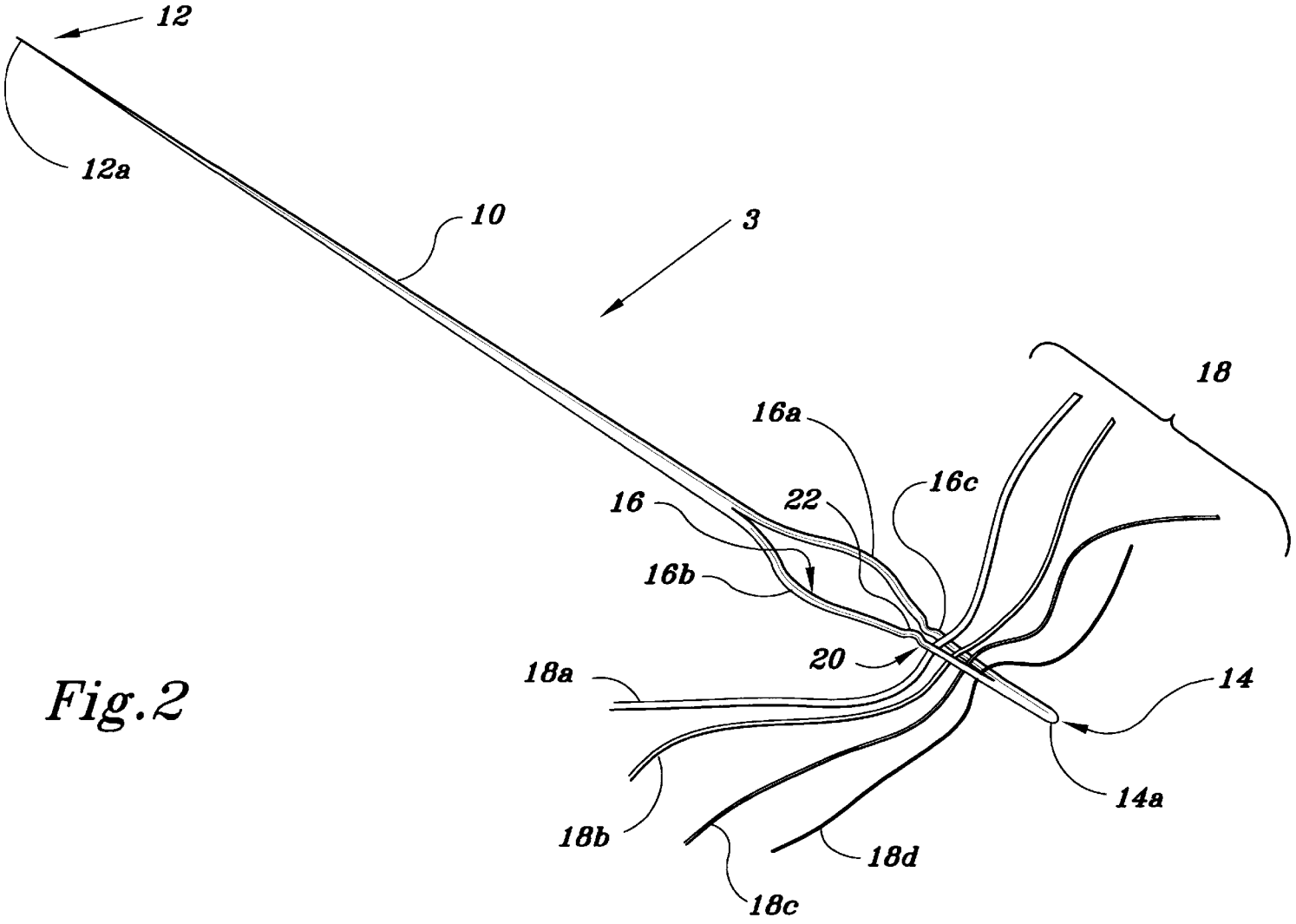
FIG. 2 is a perspective environmental view of the sewing needle according to the invention, illustrating the use of a plurality of threads having different and varying dimensions.

As shown in FIG. 2, each thread 18 may vary in spatial dimensions and texture to produce a distinct image or design when used in cross-stitching or similar stitching by user. The thickness and texture exudes a special aesthetic appeal or appreciation by a noncasual observer. This is particularly important in cross-stitching, because such hand crafts can be appreciated by friends family and others not simply as aimless art piece, but designs made with the most meticulous care for the intended effect by the skilled craftsperson.

Thus, a sewing needle which can retain a plurality of threads together in a relatively fixed longitudinal relation to one another is the most important aspect of the invention. In order to produce a tweed pattern for example, texture and color is quite significant. The number of simultaneous threads for multicolor/textured designs which should be preferably retained are at least four. The various pigments or colors of threads are left to the extent of one's imagination, but the needle 3 is preferably made of a metallic material. While dimensions of the needle 3 have not been particularly set forth, it would be obvious to one ordinary skill in the relevant art to provide a needle according to any specified length dimensions as a matter of intended use.

It is to be understood that the present invention is not limited to the sole embodiments described above, but encompasses any and all embodiments within the scope of the following claims.

I claim:

1. A sewing needle comprising:

a tapered needle shaft having a first end and a second end, said first end defining a needle point;

a primary eye proximate said second end, wherein said primary eye is defined by a pair of divergent branches extending from the shaft and terminating into a first pair of convergent branches, the convergent branches each having an inward bend to define a pinched portion characterized by a narrowed slot;

a secondary eye portion adjacent said primary eye for retaining a plurality of threads, said secondary eye portion being defined by a pair of outward bends extending from the pinched portion and terminating into a second pair of convergent branches to form the second end, said secondary eye portion having an opening substantially reduced in size relative to said primary eye.

2. The sewing needle according to claim 1, wherein said needle is made of a metallic material.

3. The sewing needle according to claim 1, wherein said second end is blunt.

4. The sewing needle according to claim 1, wherein said second end is tapered.

5. The sewing needle according to claim 1, wherein said needle point is blunt.

* * * * *